US009691562B2

(12) United States Patent
Neuhaus

(10) Patent No.: US 9,691,562 B2
(45) Date of Patent: Jun. 27, 2017

(54) ELECTRIC SWITCHING DEVICE WITH ENHANCED LORENTZ FORCE BIAS

(71) Applicant: Tyco Electronics Austria GmbH, Vienna (AT)

(72) Inventor: Alexander Neuhaus, Vienna (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 14/942,413

(22) Filed: Nov. 16, 2015

(65) Prior Publication Data

US 2016/0071677 A1 Mar. 10, 2016

Related U.S. Application Data

(63) Continuation of application No. PCT/EP2014/059404, filed on May 8, 2014.

(30) Foreign Application Priority Data

May 24, 2013 (EP) ..... 13169164

(51) Int. Cl.
*H01H 1/54* (2006.01)
*H01H 50/54* (2006.01)
(Continued)

(52) U.S. Cl.
CPC ..... *H01H 1/54* (2013.01); *H01H 50/18* (2013.01); *H01H 50/36* (2013.01); *H01H 50/54* (2013.01); *H01H 50/60* (2013.01)

(58) Field of Classification Search
CPC ..... H01H 1/54; H01H 50/54; H01H 50/18; H01H 50/60; H01H 50/36
See application file for complete search history.

(56) References Cited

U.S. PATENT DOCUMENTS 3,593,227 A * 7/1971 Mitskevich ..... H01H 77/107 218/36
4,001,738 A * 1/1977 Terracol ..... H01H 77/108 335/147

(Continued)

FOREIGN PATENT DOCUMENTS

EP 0471893 A2 * 2/1992 ..... H01H 1/54
EP 1879204 A1 1/2008
EP 2477204 A1 7/2012

OTHER PUBLICATIONS

International Search Report, International Application No. PCT/EP2014/059404, dated Jun. 24, 2014, 3 pages.

(Continued)

*Primary Examiner* — Mohamad Musleh
(74) *Attorney, Agent, or Firm* — Barley Snyder

(57) ABSTRACT

An electric switch is disclosed. The electric switch has a first terminal, a second terminal, a contact sub-assembly comprising at least two contact members disposed in a current path between the first and second terminals, the contact sub-assembly having a connecting position in which the contact members contact each other and an interrupting position in which the contact members are spaced apart from each other a Lorentz force generator comprising a first conductor member and a second conductor member, and at least one support Lorentz force generator. The Lorentz force generator and the at least one support Lorentz force generator both bias the contact sub-assembly into the connecting position, the current path extending from the first terminal to the second terminal through the contact sub-assembly in the connecting position.

20 Claims, 4 Drawing Sheets

(51) Int. Cl.
*H01H 50/18* (2006.01)
*H01H 50/36* (2006.01)
*H01H 50/60* (2006.01)

(56) References Cited

U.S. PATENT DOCUMENTS 4,467,301 A * 8/1984 Goodrich ..... H01H 1/54 335/195
4,849,590 A * 7/1989 Becker ..... H01H 1/54 200/10
5,583,471 A 12/1996 Weiser et al.
6,034,581 A 3/2000 DiMarco et al.
6,046,661 A * 4/2000 Reger ..... H01H 50/643 335/185
6,661,319 B2 * 12/2003 Schmelz ..... H01H 1/26 335/128
6,700,466 B1 3/2004 Yamamoto et al.
7,659,800 B2 * 2/2010 Gruner ..... H01H 1/26 335/185
7,710,224 B2 * 5/2010 Gruner ..... H01H 51/2281 335/129
7,902,948 B2 * 3/2011 Luders ..... H01H 9/346 218/146
8,093,974 B2 1/2012 Nagura et al.
8,373,523 B2 * 2/2013 Valdemarsson ..... H01H 1/62 335/147
8,587,394 B1 * 11/2013 Song ..... H01H 1/54 335/147
8,698,582 B2 4/2014 Uchida
9,053,885 B2 * 6/2015 Gassmann ..... H01H 1/26
2003/0112103 A1 * 6/2003 Schmelz ..... H01H 1/26 335/128

OTHER PUBLICATIONS

English translation of First Chinese Office Action, dated Nov. 22, 2016, 10 pages.
First Chinese Office Action, dated Nov. 22, 2016, 8 pages.

* cited by examiner

ELECTRIC SWITCHING DEVICE WITH ENHANCED LORENTZ FORCE BIAS

CROSS-REFERENCE TO RELATED APPLICATIONS

This application is a continuation of PCT International Application No. PCT/EP2014/059404 filed May 8, 2014, which claims priority under 35 U.S.C. §119 to European Patent No. 13169164.4 filed May 24, 2013.

FIELD OF THE INVENTION

The invention relates to an electric switch, and more particularly, to an electric switch having a Lorentz force bias.

BACKGROUND

Electric switches, such as relays, are generally known from the prior art. If the contact members are in the connecting position, a current path extends continuously through the electric switch and a current flows through the electric switch along the current path. If the contact members are moved apart, the current path and thus the current flowing through the electric switch is disrupted.

In electric switches, an electromagnetic repulsive force arises between contact members because currents flow in opposite directions in portions where the contact members contact each other. The electromagnetic repulsive force acts to separate the contact members. To avoid an accidental separation due to electromagnetic repulsive forces, it is known to bias the contact members into the connecting position by, for example, pressure springs or a Lorentz force. The electromagnetic repulsive force, however, increases as the flowing current increases; the elastic force of a biasing spring or the Lorentz force has to be increased in accordance with the increase in the current value.

The body size of the contact spring or the length of the conductor members of the Lorentz force generator thus increases with higher transmitted currents. As these sizes increase, the size of the electric switch increases, and correspondingly, the cost to manufacture the electric switch also increases. Electric switches are mass-produced articles which need to be reliable, of simple structure, and inexpensive to manufacture.

SUMMARY

An object of the invention, among others, is to provide an electric switch that can transmit high currents without increasing the size of the electric switch. The disclosed electric switch has a first terminal, a second terminal, a contact sub-assembly comprising at least two contact members disposed in a current path between the first and second terminals, the contact sub-assembly having a connecting position in which the contact members contact each other and an interrupting position in which the contact members are spaced apart from each other a Lorentz force generator comprising a first conductor member and a second conductor member, and at least one support Lorentz force generator. The Lorentz force generator and the at least one support Lorentz force generator both bias the contact sub-assembly into the connecting position, the current path extending from the first terminal to the second terminal through the contact sub-assembly in the connecting position.

BRIEF DESCRIPTION OF THE DRAWINGS

The invention will now be described by way of example with reference to the accompanying figures, of which.

DETAILED DESCRIPTION OF THE EMBODIMENT(S)

The invention is described in greater detail below with reference to embodiments of an electric switch. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 2:
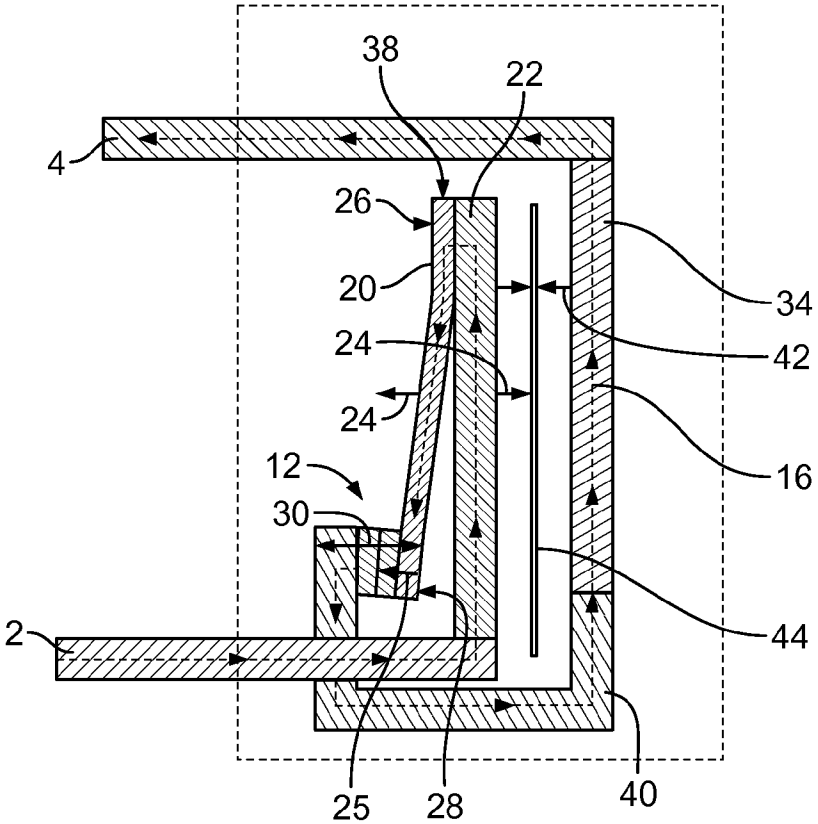
FIG. 2 is a schematic side view of the electric switch of FIG. 1 in a connecting position.
Figure 1:
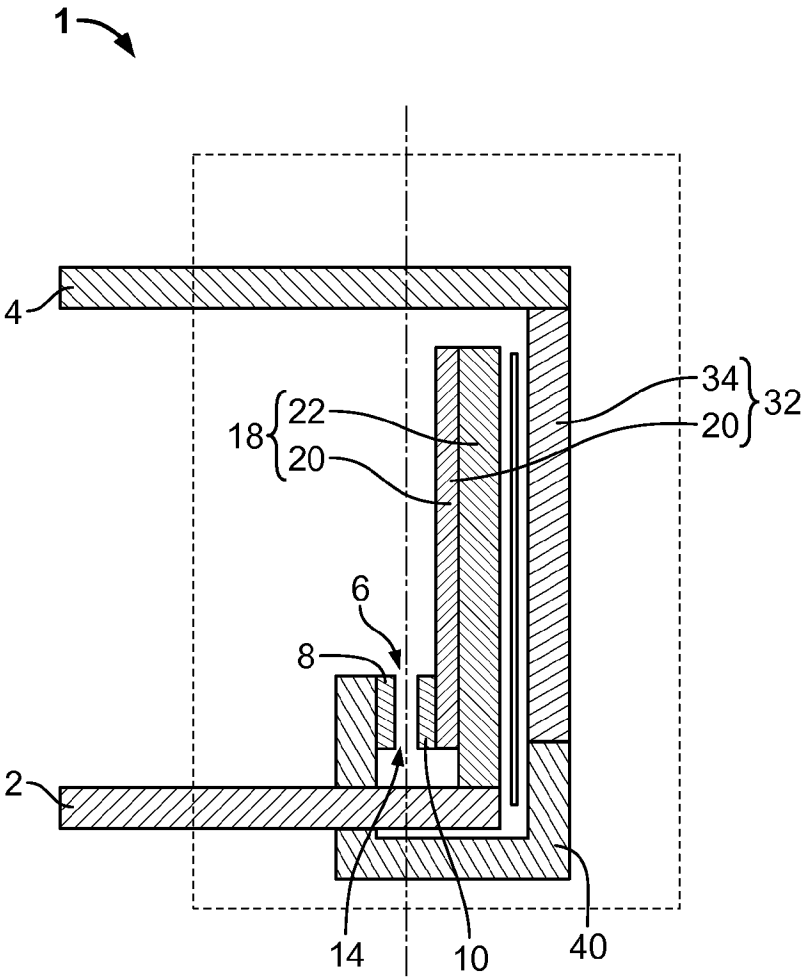
FIG. 1 is a schematic side view of an electric switch in a first embodiment according to the invention in an interrupting position.

The electric switch 1, according to a first embodiment of the invention, is shown in FIGS. 1 and 2. The electric switch 1 includes a first terminal 2, a second terminal 4, a contact sub-assembly 6, a Lorentz force generator 18, a support Lorentz force generator 32, a crossover conductor 40, and an isolation barrier 44. The major components of the invention will now be described in greater detail.

The electric switch 1 comprises a first terminal 2, a second terminal 4, and a contact sub-assembly 6 disposed between the first terminal 2 and the second terminal 4. The contact sub-assembly includes at least two contact members 8, 10. The contact members 8, 10 may face one another, as shown in the embodiment of FIGS. 1 and 2.

The electric switch 1 further comprises a Lorentz force generator 18, which may be located in series to the contact sub-assembly 6. The Lorentz force generator 18 comprises at least two conductor members 20, 22. The at least two conductor members 20, 22 of the Lorentz force generator 18 may extend parallel and adjacent to each other, as shown in FIGS. 1 and 2. A proximal end of the conductor member 22 is connected to the first terminal 2.

Figure 3:
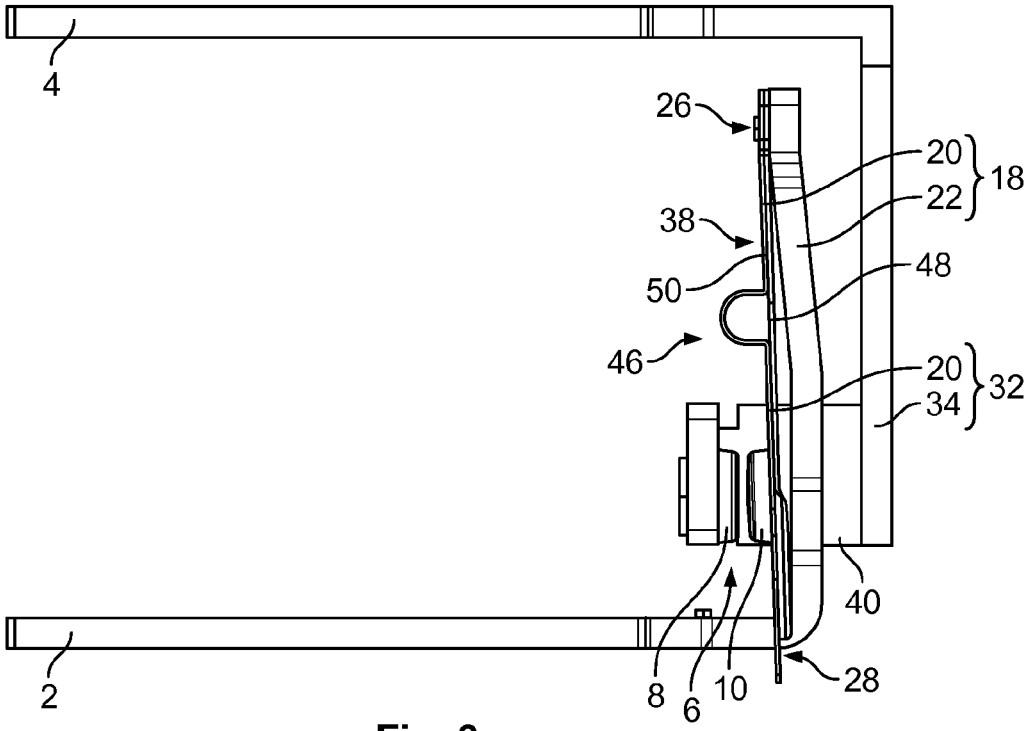
FIG. 3 is a perspective side view of the electric switch of FIG. 1.
Figure 4:
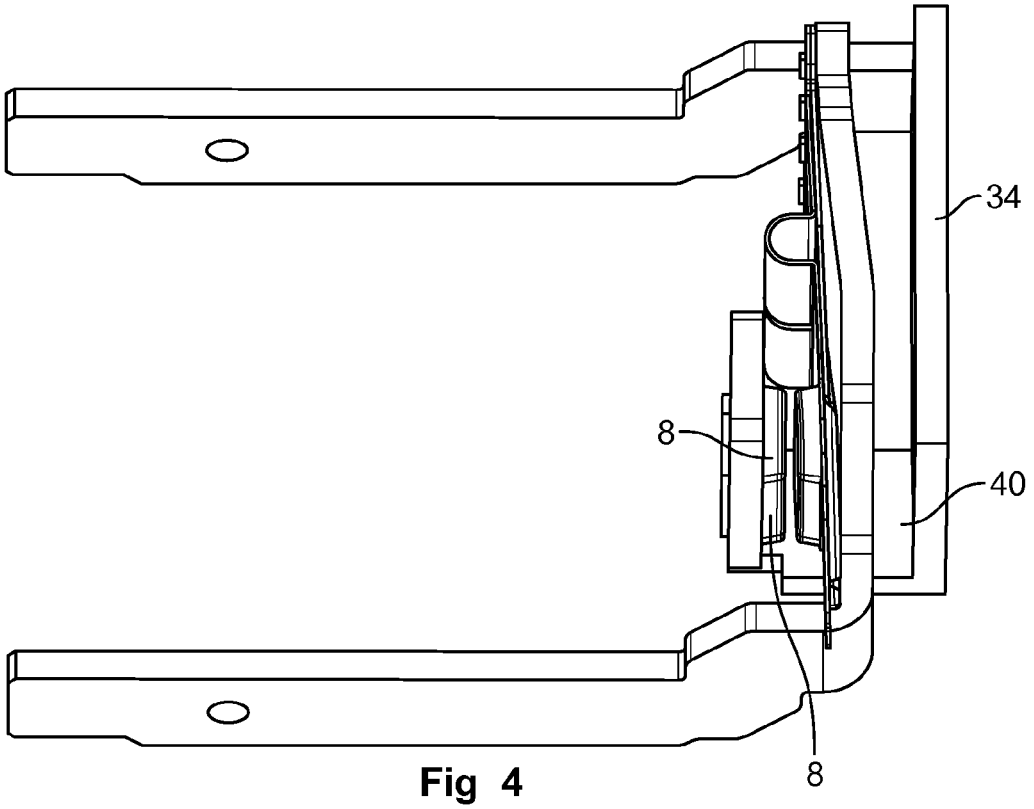
FIG. 4 is a perspective oblique view of the electric switch of FIG. 1.

The deflectable conductor member 20 is fixed at one end 26 to the distal end of conductor member 22, while the other end 28 is moveable and connected to the contact member 10. In FIGS. 3 and 4, the deflectable conductor member 20 is shown in more detail. The deflectable conductor member 20 may be divided into two or more parallel sections. Each of the sections is provided with one contact member 10 on its moveable end 28. At a mid-section 46, the deflectable conductor member 20 may have an area of increased deflectability. If the deflectable conductor member 20 comprises two or more layers 48, 50, the layers may be separated at the mid-section 46, e.g. by bending the layer 50 while keeping the layer 48 straight. This will ensure high flexibility of deflectable conductor member 20 in spite of the large cross-sections needed for high current.

The support Lorentz force generator 32 comprises at least two conductor members 20, 34. The at least two conductor members 20, 34 of the support Lorentz force generator 32 also extend parallel to each other, and in the configuration shown in FIGS. 1 and 2, all conductor members 20, 22 of the Lorentz force generator 18 and all conductor members 20, 34 of the at least one support Lorentz force generator 32 extend parallel to each other. Conductor member 34 is connected at a proximal end to the second terminal 4.

A crossover conductor 40, as shown in FIGS. 1 and 2, connects the contact member 8 of the contact sub-assembly 6 and the distal end of the conductor member 34. As can be seen in FIGS. 3 and 4, the crossover conductor 40 is supporting and, at this position, electrically contacted to the contact members 8 of the contact sub-assembly 6. The crossover conductor 40 then bridges and passes along the deflectable conductor member 20, the conductor member 22 and an isolation barrier 44 (not shown in FIGS. 3 and 4) up to the point where it is connected to the conductor member 34 of the supporting Lorentz force generator 32.

The isolation barrier 44 may be formed interposed between the conductor members 22 and 34; the isolation barrier 44 is shown as a wall in the figures, but one skilled in the art would appreciate that the isolation barrier 44 could be a variety of possible shapes and bodies.

The operation of the electric switch 1 will now be described.

The contact sub-assembly 6 may be moved from an interrupting position 14 shown in FIG. 1, in which the contact members 8, 10 are spaced apart from each other, to a connecting position 12 shown in FIG. 2. In the connecting position 12, the contact members 8, 10 contact each other. In the connecting position 12, a current path 16, indicated by the small arrows in the figures, extends between the first and the second terminals 2, 4. Thus, an electric current may flow between the first terminal 2 and the second terminal 4 along the current path 16. In the interrupting position 14, the current path is interrupted at the contact sub-assembly 6, whose contact members 8, 10 are spaced apart from each other, and no current may flow between the terminals 2, 4.

The Lorentz force generator 18 may be located in the current path 16 in front of or behind the contact sub-assembly 6. In the embodiment shown in FIGS. 1 and 2, the Lorentz force generator 18 is located in the current path 16 in front of the contact sub-assembly 6.

After the electric switch 1 has been transferred from the interruption position 14 to the connecting position 12, e.g. by means of an electromagnetic drive system (not shown), the Lorentz force generator 18 generates a Lorentz force 24. The conductor members 20, 22 are located in the current path 16. If the conductor members 20, 22 are fixed to each other at the fixed end 26 of the conductor member 20, the conductor members 20, 22 may be connected in series within the current path 16. If an electric current is applied along the current path 16, the Lorentz force 24 is generated, which acts between the conductor members 20, 22.

The direction of a Lorentz force 24 depends on the direction of the current in the conductor members 20, 22. If the current is of the same direction in the conductor members 20, 22, the Lorentz force 24 will act to attract the conductor members 20, 22 to each other. In the embodiment shown, the direction of the current in the conductor member 20 is opposite to the direction of the current in the conductor member 22, consequently, the Lorentz force 24 will push the conductor members 20, 22 apart.

As shown in FIGS. 1 and 2, at least one of the conductor members 20, 22 may be configured to be deflected by the Lorentz force 24 relative to an initial current-less state, which may be the interrupting position 14 shown in FIG. 1. By way of example only, it is the conductor member 20 in the embodiment which is deflected by the Lorentz force 24; the deflection of the conductor member 20 may in particular be an elastic deformation.

If the conductor member 20 is deflected by the Lorentz force 24, the moveable end 28, which may be provided with a contact member 10 of the contact sub-assembly 6, is pressed against the contact member 8 of the contact sub-assembly 6, thereby biasing the contact sub-assembly 6 into the connecting position 12 shown in FIG. 2. The contact force 25 pressing the contact members 8, 10 into contact with each other is thus a result of the Lorentz force 24. In the shown embodiment, the contact member 8 is fixed in position, i.e. non-moveable.

Additionally, when a current flows through the contact sub-assembly 6, an electromagnetic repulsive force 30, shown in FIG. 2, arises between the contact members 8, 10. The electromagnetic repulsive force 30 acts to separate the contact members 8, 10 from each other. Such separation would disrupt the current path 16 accidentally and generate a switching arc between the contact members 8, 10, which is to be avoided. While the maximum Lorentz force 24 that the Lorentz force generator 18 is capable of generating is limited, for example by the distance between the conductor members 20, 22 and the length of the two conductor members 20, 22, the electromagnetic repulsive force 30 continues to rise with increasing currents flowing through the current path 16. At very high currents flowing through the current path 16, the electromagnetic repulsive force 30, acting to separate the contact members 8, 10 from each other, may exceed the Lorentz force 24 of the Lorentz force generator 18 pressing the contact members 8, 10 against each other. It is thus desirable to increase the contact force biasing the contact members 8, 10 of the contact sub-assembly 6 into the connecting position 12 as far as possible, so the contact force 25 exceeds the repulsive force 30 and the electric switch 1 may sustain even very high current values.

According to the invention, the contact force 25 biasing the contact sub-assembly 6 into the connecting position 12 generated by the Lorentz force generator 18 is amplified by means of the least one support Lorentz force generator 32.

The support Lorentz force generator 32 comprises at least two conductor members 20, 34. The conductor members 20, 34 are located in the current path 16. If a current is applied along the current path 16, a further Lorentz force, called an enforcing Lorentz force 36, is generated which acts between the conductor members 20, 34. In the embodiment shown, the direction of the current in the conductor member 20 is opposite to the direction of the current in the conductor member 34. Thus, the enforcing Lorentz force 36 will also push the contact member 10 against the contact member 8, thus generating a second component of the contact force 25 and amplifying the contact force 25 biasing the contact sub-assembly 6 into the connecting position 12. In the embodiment shown in FIGS. 1 and 2, the deflector conductor member 20 is a joint conductor member 38, since it is a conductor member of the Lorentz force generator 18 and also a conductor member of the at least one support Lorentz force generator 32.

In the shown embodiment, the conductor members 20, 22 of the Lorentz force generator 18 are connected in series and the conductor members 20, 34 of the support Lorentz force generator 32 are also connected in series. The conductor members 20, 22 of the Lorentz force generator 18 extend parallel to each other, which maximizes the Lorentz force 24 generated. The at least two conductor members 20, 34 of the support Lorentz force generator 32 also extend parallel to each other, which maximizes the enforcing Lorentz force 36, thereby maximizing the contact force 25 which is the result of the combined Lorentz force 24 and enforcing Lorentz force 36 acting in the same direction on the deflectable conductor member 20.

The generated Lorentz force 24, 36 may be increased by placing the conductor members 20, 22/20, 34 extending adjacent to each other. In the first embodiment shown in FIGS. 1 and 2, the conductor members 20, 22 of the Lorentz force generator 18 extend immediately adjacent to each other, thereby maximizing the Lorentz force 24 generated. Conductor member 34 of the support Lorentz force generator 32 extends adjacent to the conductor member 22 of the Lorentz force generator 18 and opposite to the joint conductor member 38, which is the deflectable conductor member 20. The conductor member 22 is thus physically positioned between the conductor member 34 and the conductor member 20. With respect to the direction of contact force 25 biasing the contact sub-assembly 6 in the connecting position 12, the conductor members 20, 22, 34 are placed adjacent to each other in the arrangement: conductor member 34 of the support Lorentz force generator 32, conductor member 22 of the Lorentz force generator 18 and joint conductor member 38 of the Lorentz force generator 18 and the support Lorentz force generator 32.

As can best be seen in FIG. 2, the current is flowing in the same direction through the conductor members 22 and 34 of the Lorentz force generator 18 and the support Lorentz force generator 32, respectively. This results in a further by-product Lorentz force 42, which acts to attract the conductor members 22, 34. To compensate the undesired by-product Lorentz force 42, the conductor members 22, 34 may be more rigid than the deflectable conductor member 20, which has spring-like abilities. The rigid conductor members 22, 34 may be regarded as a rigid body which does not deform over the operational range currents of the Lorentz force generators 18, 32.

To ensure an isolation of the current running through the adjacent conductor members 22, 34, the isolation barrier 44 first isolates the conductor members 22, 34 electrically. Further, the isolation barrier 44 may be a supporting element compensating and absorbing the by-product Lorentz force 42. Hence, even if the conductor members 22, 34 deform under the by-product Lorentz force 42, the supporting element 44 will prevent a short circuit due to the interposed isolation barrier 44. Alternative embodiments of the isolation barrier may be at least one isolation post placed where the by-product Lorentz force 42 results in the largest deformation of the conductor members 22, 34.

Figure 6:
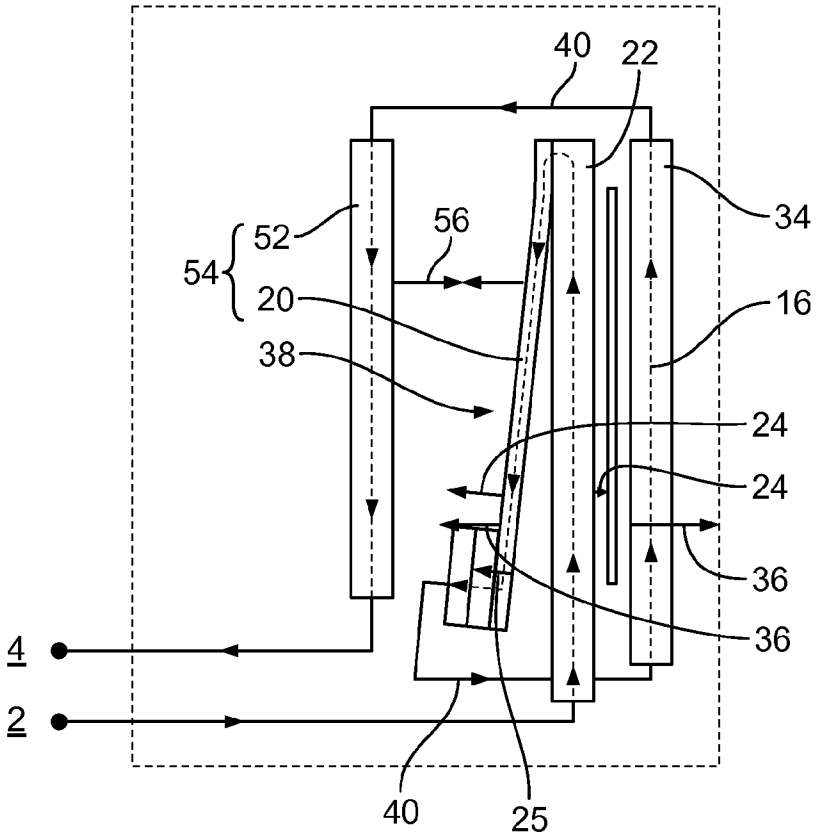
FIG. 6 is a schematic side view of an electric switch according to a third embodiment of the invention in a connecting position.
Figure 7:
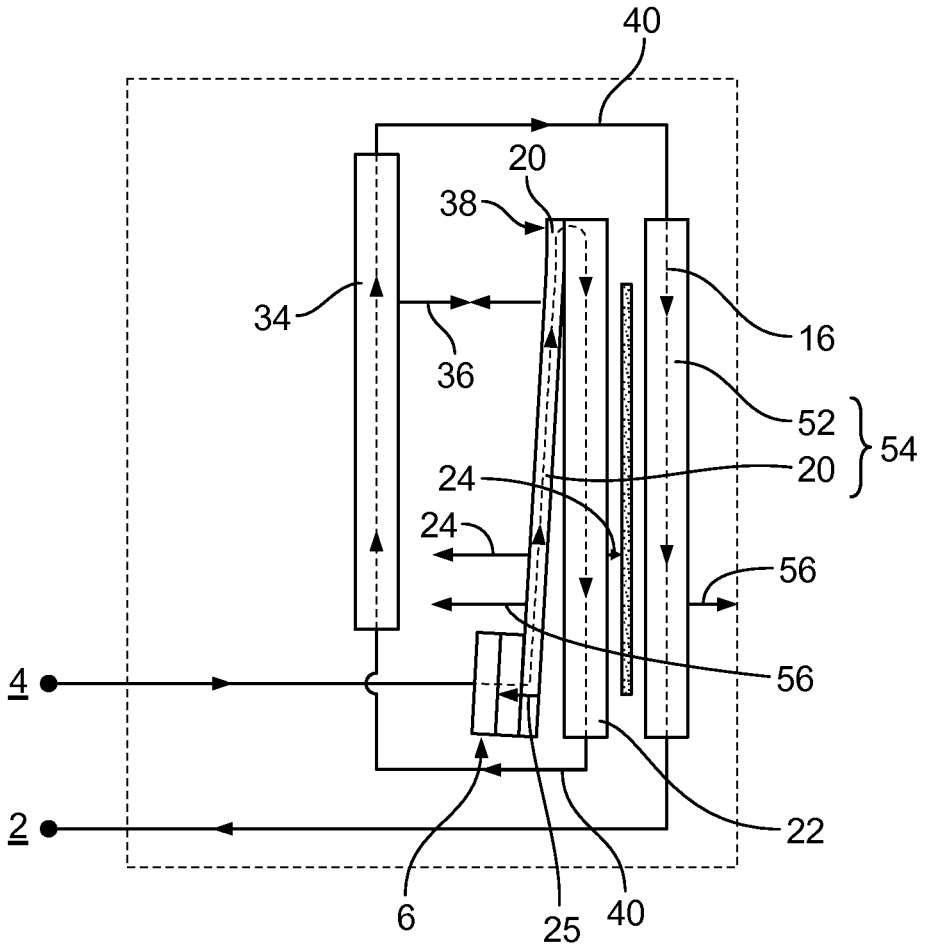
FIG. 7 is a schematic side view of an electric switch according to a fourth embodiment of the invention in a connecting position.

In the following, alternative embodiments of an electric switch 1 according to the invention are shown with reference to FIGS. 5 to 7. In the following, only the differences between the electric switch 1 according to the first embodiment shown in FIGS. 1 to 4 and the subsequent embodiments shown in FIGS. 5 to 7 will be described. For elements that are structurally and/or functionally similar or identical to elements of the previous embodiments, the same reference signs will be used. To keep the figures simple, some of the reference numerals of FIGS. 1 to 4 have been omitted in FIGS. 5 to 7 and the crossover conductors are only schematically shown as a simple line. All electric switches 1 in the following FIGS. 5 to 7 are shown in the connecting position 12.

Figure 5:
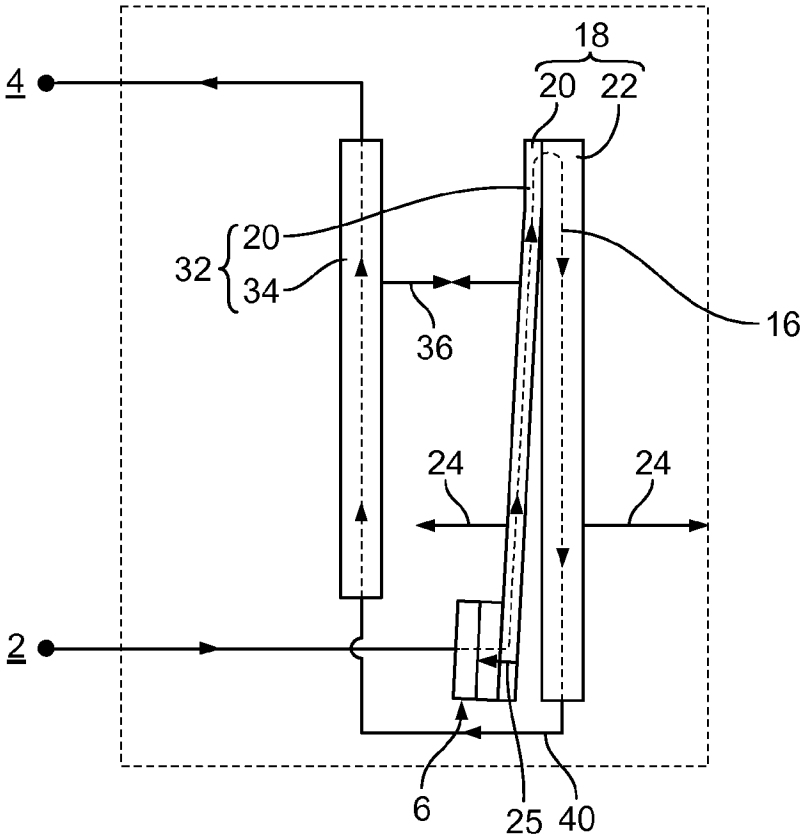
FIG. 5 is a schematic side view of an electric switch according to a second embodiment of the invention in a connecting position.

The second embodiment of the electric switch 1 of the invention, shown in FIG. 5, comprises a first Lorentz force generator 18, a deflectable conductor member 20 and a rigid conductor member 22, as well as a contact sub-assembly 6 having two contact members 8, 10, similar to the electric switch 1 shown in FIG. 1. However, the current path 16 is different in that the first terminal 2 is directly connected with the contact sub-assembly 6, and then continues, in series, to the deflectable conductor member 20 and the conductor member 22 of the Lorentz force generator 18.

The support Lorentz force generator 32 comprises the deflectable conductor member 20, which is hence also a joint conductor member 38, as well as a conductor member 34. Contrary to the embodiment of FIGS. 1 to 4, the conductor member 34 is physically positioned such that the deflectable conductor member 20 is interposed between the conductor members 22 and 34. For transferring current from the conductor member 22 to the conductor member 34, a crossover conductor 40 is used, which may be of similar design as the crossover conductor 40 shown in FIG. 1 for bridging the deflectable conductor member 20 and the contact sub-assembly 6.

If an electric current is applied along the current path 16, an enforcing Lorentz force 36 is generated, which acts between the conductor members 20, 34 of the support Lorentz force generator 32. In the embodiment shown in FIG. 5, the current is of the same direction as in the conductor members 20, 34. Thus, the support Lorentz force generator 32 will generate an enforcing Lorentz force 36 that will act to attract the conductor members 20, 34 to each other, thereby deflecting the deflectable conductor member 20 towards the conductor member 34, resulting in an amplified contact force 25 biasing the contact sub-assembly into the connecting position 12. For the sake of simplicity, the by-product Lorentz force 42 generated between the conductor members 22, 34 is omitted in FIGS. 5 to 7.

FIG. 6 shows a third embodiment of the electric switch 1 of the present invention. The electric switch 1 of FIG. 6 principally corresponds to the switch 1 of the first embodiment shown in FIGS. 1 to 4. Contrary to the first embodiment of FIGS. 1 to 4, in the third embodiment shown in FIG. 6, the conductor member 34 is not directly connected in series with the second terminal 4. Rather, a second crossover conductor 40' is connecting the conductor member 34 followed by a further conductor member 52, which is in turn connected to the second terminal 4. The conductor member 52 extends substantially parallel to the other conductor members 20, 22, 34. The conductor member 52 is physically positioned, with respect to the deflectable conductor member 20, opposite to the conductor member 22, so the conductor member 20 is physically positioned in between the conductor members 52, 22.

The conductor member 52 and the deflectable conductor member 20 constitute a second support Lorentz force generator 54. If an electric current is applied along the current path 16, a second enforcing Lorentz force 56 is generated, which acts between the conductor members 52 and 20. Since the current is of the same direction as in the conductor members 20, 52, the second enforcing Lorentz force 56 will act to attract the conductor members 20, 52 to each other, resulting in the deformation of the deflectable conductor member 20 towards the conductor member 52. Thus, the second enforcing Lorentz force 56 may directly act on the contact sub-assembly as a further amplifying contact force 25. To keep FIG. 6 simple, the by-product Lorentz forces generated between the conductor members 22, 34 and 52 are omitted in FIG. 6.

In the embodiment shown in FIG. 6, the deflectable conductor member 20 is a joint conductor member 38 of the Lorentz force generator 18, of the first support Lorentz force generator 32 as well as of the second support Lorentz force generator 54.

FIG. 7 shows a fourth embodiment of the electric switch 1 of the present invention. The electric switch 1 of FIG. 7 principally corresponds to the switch 1 of the second embodiment shown in FIG. 5. Contrary to the second embodiment of FIG. 5, in the fourth embodiment shown in FIG. 7, the conductor member 34 is not directly connected in series with the second terminal 4. Rather, a second crossover conductor 40' is connecting the conductor member 34 with a further conductor member 52, which is in turn connected to the second terminal 4. The conductor member 52 extends substantially parallel to the other conductor members 20, 22, 34. The conductor member 52 is arranged, with respect to the conductor member 22, opposite to the deflectable conductor member 20, so the conductor member 22 is arranged in between the conductor members 52, 20, similar to the configuration of the Lorentz force generator 18 and the support Lorentz force generator 32 of FIGS. 1 to 4.

The conductor member 52 and the deflectable conductor member 20 constitute a second support Lorentz force generator 54. If an electric current is applied along the current path 16, a second enforcing Lorentz force 56 is generated, which acts between the conductor members 52 and 20. Since the current is of opposite direction in the conductor members 20, 52, the second enforcing Lorentz force 56 will act to push the conductor members 20, 52 away from each other. Thus, the second enforcing Lorentz force 56 may directly act on the contact sub-assembly as a further amplifying contact force 25. To keep FIG. 7 simple, the by-product Lorentz force 42 generated between the conductor members 22, 34 and 52 is omitted in FIG. 7.

In the embodiment shown in FIG. 7, the deflectable conductor member 20 is a joint conductor member 38 of the Lorentz force generator 18, of the first support Lorentz force generator 32 as well as of the second support Lorentz force generator 54.

The illustrated embodiments of the electric switch 1 according to the invention may be further defined by adding additional conductor members constituting further support Lorentz force generators, which may further amplify the contact force biasing the contact sub-assembly 6 in the connecting position 12. In this way, a compact electric switch 1 generating a very high contact force 25 biasing the contact sub-assembly 6 in the connecting position 12 may be provided.

Advantageously, incorporating multiple Lorentz force generators allows for the electric switch of the invention to sustain a connection between the terminals, even under a high current. The use of a joint conductor member in the electric switch of the invention reduces the total number of conductor members in the Lorentz force generators, which makes the construction of the electric switch easier and reduces the conductor material, and cost, of such an electric switch. Furthermore, the parallel orientation of the conductor members minimizes the spatial requirements for placing the conductor members and allows for a compact construction of the electric switch. The electric switch according to the invention is also reliable over many switching cycles because the generation of a Lorentz force does not lead to mechanic abrasion or other wear at the conductor members.

What is claimed is:

1. An electric switch, comprising:

a first terminal;

a second terminal;

a contact sub-assembly comprising at least two contact members disposed in a current path between the first and second terminals, the contact sub-assembly having a connecting position in which the contact members contact each other and an interrupting position in which the contact members are spaced apart from each other;

a Lorentz force generator comprising a first conductor member and a second conductor member; and at least one support Lorentz force generator;

wherein the Lorentz force generator and the at least one support Lorentz force generator both bias the contact sub-assembly into the connecting position, the current path extending from the first terminal to the second terminal through the contact sub-assembly in the connecting position.

2. The electric switch according to claim 1, wherein the Lorentz force generator generates a Lorentz force acting on the first and second conductor members to bias the contact sub-assembly into the connecting position and provide a contact force at the contact sub-assembly.

3. The electric switch according to claim 2, wherein the at least one support Lorentz force generator provides an additional contact force at the contact sub-assembly.

4. The electric switch according to claim 3, wherein a first support Lorentz force generator comprises the second conductor member and a third conductor member.

5. The electric switch according to claim 4, wherein the second conductor member is deflected by the generated Lorentz force.

6. The electric switch according to claim 5, wherein the second conductor member has a fixed end and a moveable end opposite the fixed end.

7. The electric switch according to claim 6, wherein a contact member is disposed on the moveable end.

8. The electric switch according to claim 7, wherein the third conductor member is disposed in the current path between the contact sub-assembly and the second terminal.

9. The electric switch according to claim 8, wherein the first conductor member and second conductor member are disposed in the current path between the first terminal and the contact sub-assembly.

10. The electric switch according to claim 9, wherein the first, second and third conductor members are all parallel and adjacent to each other, and the first conductor member is physically positioned between the second and third conductor members.

11. The electric switch according to claim 10, further comprising an isolation barrier positioned between the first conductor member and the third conductor member.

12. The electric switch according to claim 8, wherein the first conductor member and second conductor member are disposed in the current path between the contact sub-assembly and the third conductor member.

13. The electric switch according to claim 12, wherein the first, second and third conductor members are all parallel and adjacent to each other, and the second conductor member is physically positioned between the first and third conductor members.

14. The electric switch according to claim 1, wherein the first and second conductor members are fixed to one another.

15. The electric switch according to claim 5, further comprising a second support Lorentz force generator, the second support Lorentz force generator comprises the second conductor member and a fourth conductor member.

16. The electric switch according to claim 15, wherein the first conductor member and second conductor member are disposed in the current path between the first terminal and the contact sub-assembly, and the third conductor member is disposed in the current path between the contact sub-assembly and the fourth conductor member.

17. The electric switch according to claim 16, wherein the first, second, third, and fourth conductor members are all parallel and adjacent to each other, and the second conductor member is physically positioned between the first and fourth conductor members.

18. The electric switch according to claim 17, further comprising an isolation barrier positioned between the first conductor member and the third conductor member.

19. The electric switch according to claim 15, wherein the first conductor member and second conductor member are disposed in the current path between the contact sub-assembly and the third conductor member, and the fourth conductor member is disposed in the current path between the third conductor member and a terminal.

20. The electric switch according to claim 19, wherein the first, second, third, and fourth conductor members are all parallel and adjacent to each other, and the first conductor member is physically positioned between the second and fourth conductor members.

* * * * *